US010336128B2

(12) United States Patent
Medhin

(10) Patent No.: US 10,336,128 B2
(45) Date of Patent: Jul. 2, 2019

(54) LEFT HANDED FOUNTAIN PEN

(71) Applicant: Michael S. Medhin, Alexandria, VA (US)

(72) Inventor: Michael S. Medhin, Alexandria, VA (US)

( * ) Notice: Subject to any disclaimer, the term of this patent is extended or adjusted under 35 U.S.C. 154(b) by 115 days.

(21) Appl. No.: 15/410,255

(22) Filed: Jan. 19, 2017

(65) Prior Publication Data

US 2018/0201047 A1 Jul. 19, 2018

(51) Int. Cl.

| | |
|---|---|
| ***B43K 5/02*** | (2006.01) |
| ***B43K 5/18*** | (2006.01) |
| ***B43K 1/02*** | (2006.01) |

(52) U.S. Cl.

CPC ..... *B43K 5/1818* (2013.01); *B43K 1/02* (2013.01); *B43K 5/1809* (2013.01); *B43K 5/1836* (2013.01); *B43K 5/1845* (2013.01)

(58) Field of Classification Search

CPC ..... B43K 1/02; B43K 5/1809; B43K 5/1818; B43K 5/1836; B43K 5/1845; B43K 5/00

USPC ..... 401/235, 6, 232

See application file for complete search history.

(56) References Cited

U.S. PATENT DOCUMENTS

| | | | | |
|---|---|---|---|---|
| 3,187,724 | A * | 6/1965 | Zepell | B43K 5/16 401/108 |
| 3,352,621 | A | 11/1967 | Fehling et al. | |
| 4,679,954 | A | 7/1987 | Ambasz | |
| D311,211 | S | 10/1990 | Oot | |
| 5,012,663 | A | 5/1991 | Brown | |
| 5,172,994 | A | 11/1992 | Brown | |
| D345,579 | S | 3/1994 | Yanez, Jr. | |
| 5,527,124 | A | 6/1996 | Kolaric | |
| 5,564,849 | A | 10/1996 | Greer, Jr. | |
| 5,988,921 | A | 11/1999 | Medhin | |
| 6,789,975 | B1 * | 9/2004 | Nicoll | B43K 5/1845 401/232 |

FOREIGN PATENT DOCUMENTS

| | | |
|---|---|---|
| DE | 9000724 | 4/1990 |
| FR | 1253384 | 2/1961 |
| GB | 222374 | 10/1924 |
| WO | 91/16210 | 10/1991 |

* cited by examiner

*Primary Examiner* — Jennifer C Chiang

(74) *Attorney, Agent, or Firm* — Andrew M. Calderon; Roberts Mlotkowski Safran Cole & Calderon, P.C.

(57) ABSTRACT

Angled fountain pens are provided. A pen includes: a shank; an ink tube; a connector connected to the ink tube and the shank; a feeder connected to the connector; and a nib connected to the feeder. A writing tip of the nib extends through a hole in the feeder. The writing tip is resiliently biased against the feeder and is selectively moveable between a first position in which ink flow between the writing tip and the feeder is prevented and a second position in which ink flow between the writing tip and the feeder is permitted.

18 Claims, 16 Drawing Sheets

1

1
1

1
1
1

1
1

1
1

LEFT HANDED FOUNTAIN PEN

FIELD OF THE INVENTION

The invention generally relates to the field of writing utensils and, more particularly, to fountain pens for alleviating poor posture during writing.

BACKGROUND

Many written languages, such as English, are read from left to right and written in the same direction. To write in such a language, a person holding a pen in their right hand (e.g., a right hander) drags the pen from left-to-right across a writing surface (e.g., a piece of paper). In contrast, a person writing with a pen in their left hand (e.g., a left hander) pushes the pen from left-to-right across the writing surface. The natural position of the pen in the left hand causes the pen to be inclined into the paper in the direction of writing and consequently aligns the pressure being exerted by the left hand against the paper with the direction of movement. This contrasts with a right-hander whose writing pressure is directed opposite the direction of movement across the page. These facts thus present a number of problems for a person holding a pen in their left hand while writing from left to right.

Similar problems may exist for a person holding a pen in their right hand while writing from right to left. There are a number of languages that are written in the right to left direction, including: Arabic script, Hebrew alphabet, Syriac alphabet, Samaritan alphabet, Mandaic alphabet, Thaana, Mende Kikakui, N'Ko script, and Adlam. A right handed person holding a pen in their right hand and pushing the pen from right to left across a written page will experience the same problems as a left handed person holding a pen in their left hand and pushing the pen from left to right across the written page.

For example, as a pen is pushed by a left hand in a left-to-right writing direction, the left hand may be dragged across the face of the newly inked paper, causing it to smear. This is a function of the left-to-right direction of travel of the pen relative to the page. Moreover, the inclination of the pen against the paper, i.e., the left hand pushing the pen into the paper while holding the pen in the natural position, causes the tip of the pen to be jammed into the paper, which may cause the paper to rip. To avoid these problems, a left hander often compensates by repositioning one or more of their torso, arm, wrist, and fingers relative to place the pen at a desired angle relative to the writing surface. This physical repositioning comes at a cost to the writer, however, in the form of aches, pain, poor posture, and even carpal tunnel syndrome in prolonged cases.

Pens specifically designed for left handed writers are known in the art. For example, U.S. Pat. No. 5,988,921 issued to the same inventor, discloses an embodiment in which only the tip of a pen is angled. It has been found that this arrangement creates an off-center pivot point and places the pen out of alignment with the central axis that is naturally present in writing instruments, making the pen somewhat uncomfortable and difficult to use.

SUMMARY

An object of the invention is to empower writers with the best most mechanically sound writing position possible while maintaining an ergonomic hand and body position. Attempting to drag the tip of the writing point across (instead of pushing it into) the writing surface is the main reason why left handers contort their body, arm, and wrist when using conventional pens. In contrast to conventional pens, pens in accordance with aspects of the invention help left handers avoid having to contort their wrist, arm and body to find a drag position of the point. In embodiments, the writing point of the pen is coincident with a center line of symmetry of the handle, shank, or hand held part of the pen. Keeping the symmetry of the body and the pen prevents creating an off-center pivot point that makes it difficult or uncomfortable for the writer to maintain balance of the writing utensil. In embodiments, when the inventive pen is held in a user's left hand, a center line of the conical tip of the pen is at an angle between 90 and 45 degrees with the writing surface leaning to the right of a vertical plane, while having the writing tip of the pen on the same symmetrical line as the handle of the pen. Conversely, when the inventive pen is held in a user's right hand, a center line of the conical tip of the pen is at an angle between 90 and 45 degrees with the writing surface leaning to the left of a vertical plane, while having the writing tip of the pen on the same symmetrical line as the handle of the pen. To accomplish this arrangement, the conical tip of the pen forms an angle in the opposite direction of the shank.

In an aspect of the invention, there is a pen including: a shank; an ink tube; a connector connected to the ink tube and the shank; a feeder connected to the connector; and a nib connected to the feeder. A writing tip of the nib extends through a hole in the feeder. The writing tip is resiliently biased against the feeder and is selectively moveable between a first position in which ink flow between the writing tip and the feeder is prevented and a second position in which ink flow between the writing tip and the feeder is permitted.

In another aspect of the invention, there is a pen including: a shank; an ink tube; a connector connected to the ink tube and the shank; a feeder connected to the connector; and a nib connected to the feeder. The feeder comprises a concave surface and a convex surface. The nib comprises: an inner element covering the concave surface; an outer element covering the convex surface; and a writing contact tip. The inner element is resiliently biased against a portion of the feeder and is selectively moveable between a first position in which ink flow between the inner element and the portion of the feeder is prevented and a second position in which ink flow between the inner element and the portion of the feeder is permitted.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention generally relates to the field of writing utensils and, more particularly, to fountain pens for alleviating poor posture during writing. According to aspects of the invention, a fountain pen includes a nib having a writing contact point that is structured and arranged to bend backward toward the writer's hand when the writer is pushing the pen forward in a writing motion. In this manner, the writing contact point drags along the surface of the paper rather than being gouged into the surface of the paper.

Figure 1:
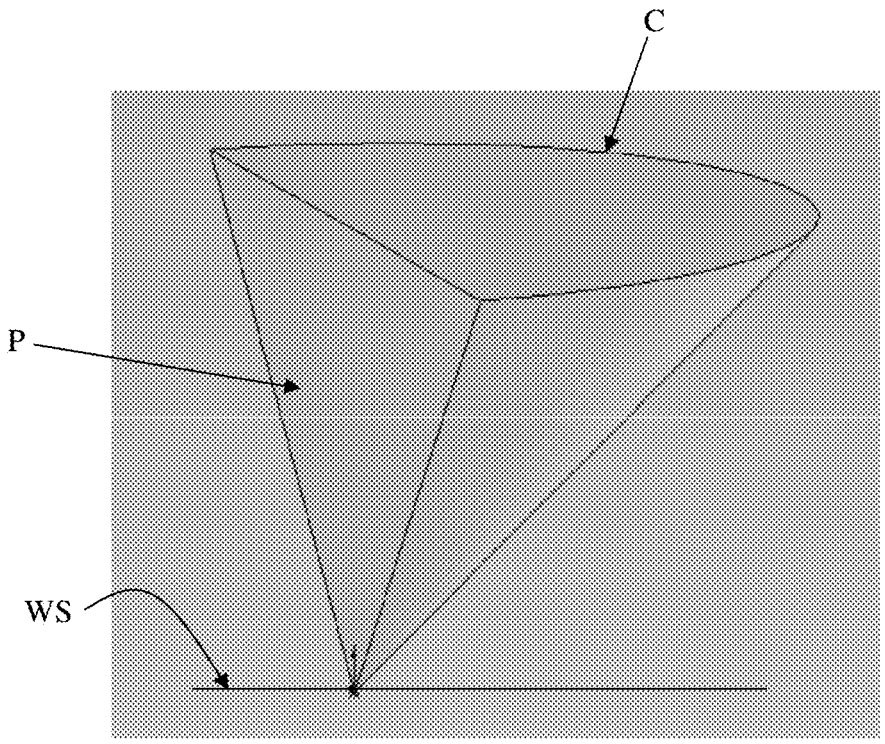
FIG. 1 shows a volume of preferred angles in accordance with aspects of the invention.

FIG. 1 shows half of a cone "C" that is on the right side of the page or in the direction of the written word and the point at the bottom is where the point of a writing utensil will come in contact the writing surface "WS". To avoid the noted problems associated with pushing the writing tip of the pen into the page when holding the pen in the left hand and writing from left to right, the best writing position results when the writing tip of the pen is in the range of angles formed on the right side of a plane "P" that bisects the cone and is perpendicular to the writing surface. The opposite half-cone (not shown) is optimal when holding the pen in the right hand and writing from right to left. It is within this range of angles defined by the bisected cone that will result in the writing tip of the pen being dragged across the writing surface, rather than being pushed into the writing surface.

Figure 2:
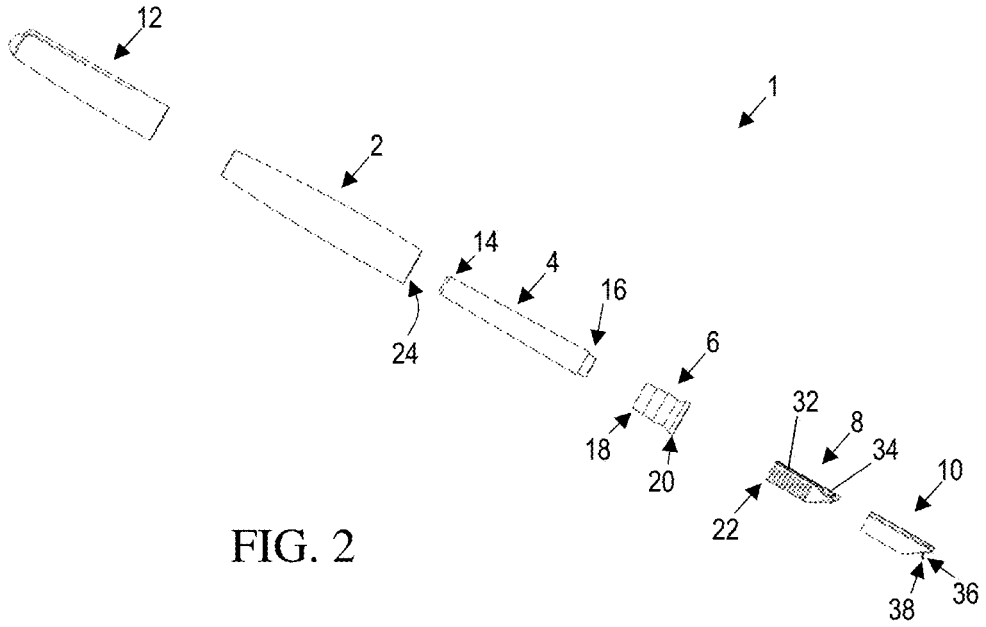
FIGS. 2-14 and 15A-L show a pen in accordance with aspects of the invention.
Figure 3:
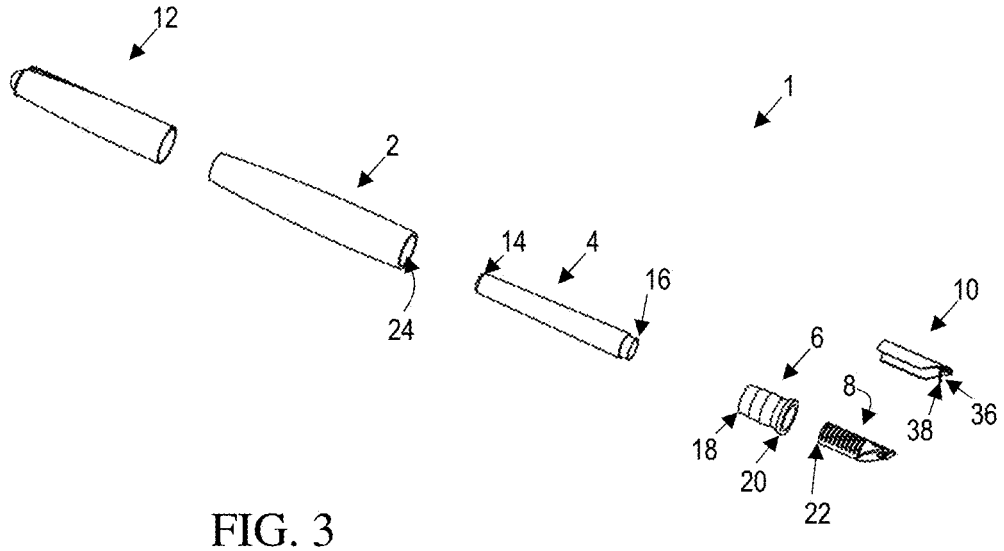
Figure 4:
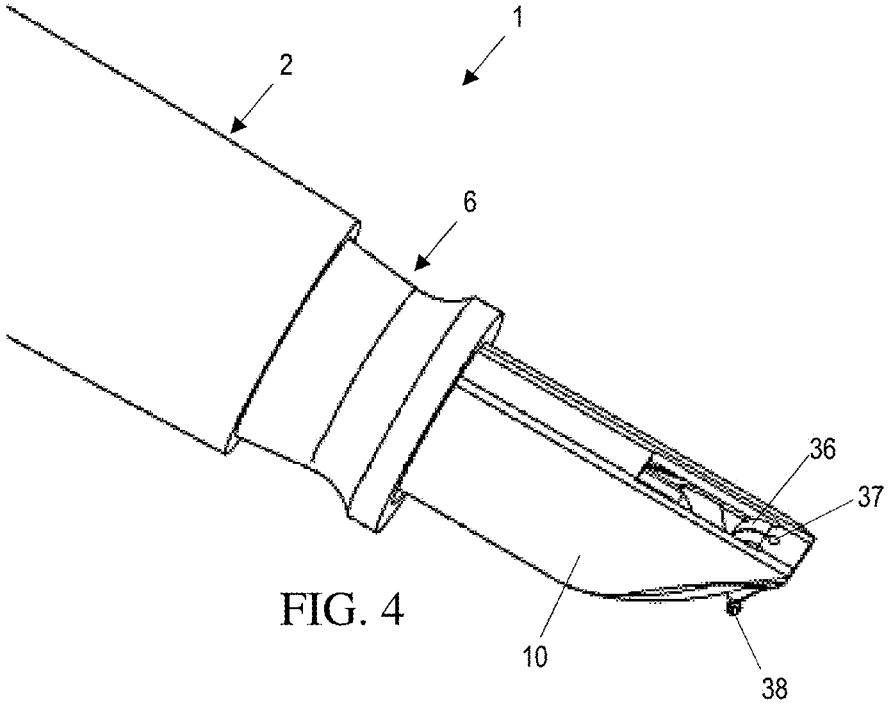
Figure 5:
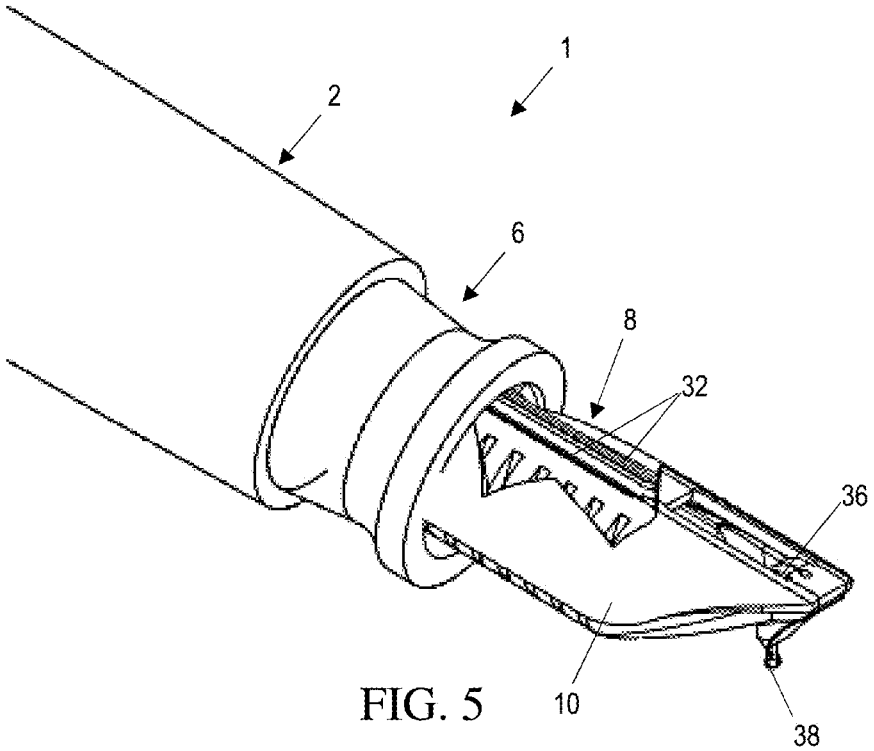
Figure 6:
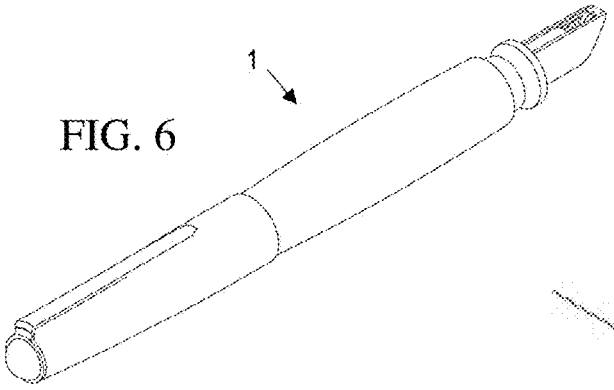
Figure 7:
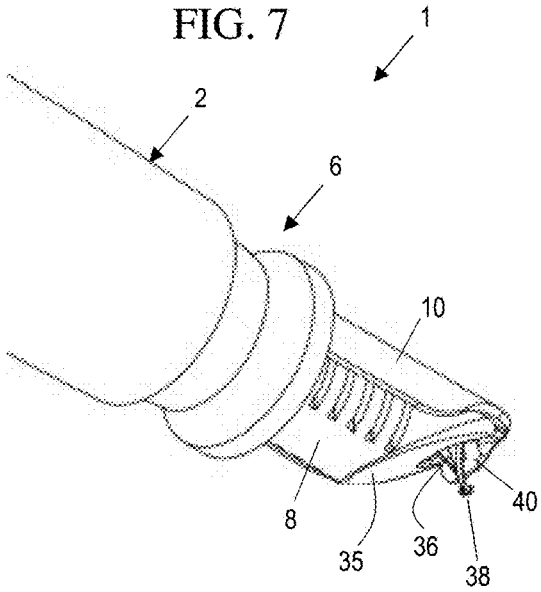
Figure 8:
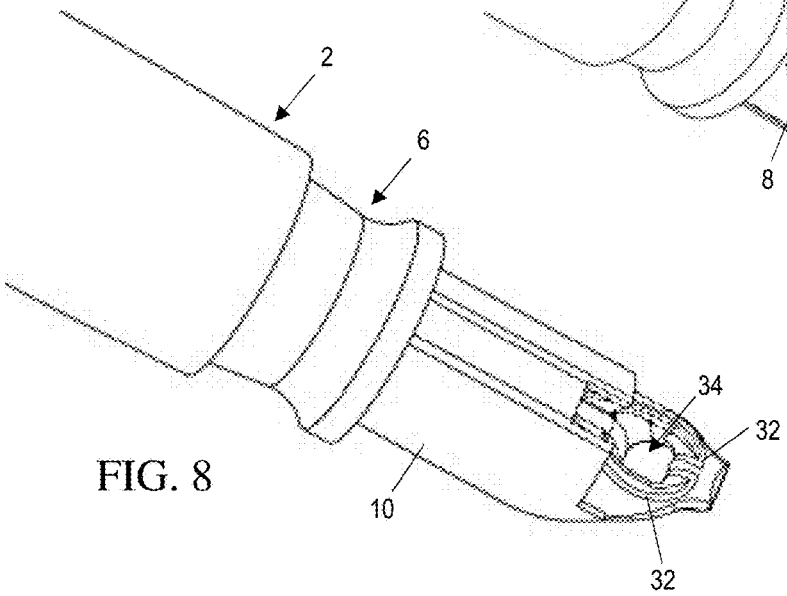
Figure 9:
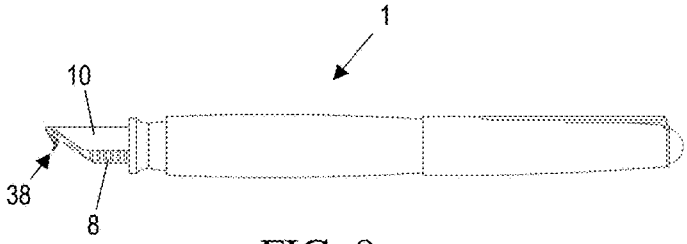
Figure 10:
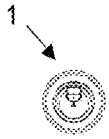
Figure 11:
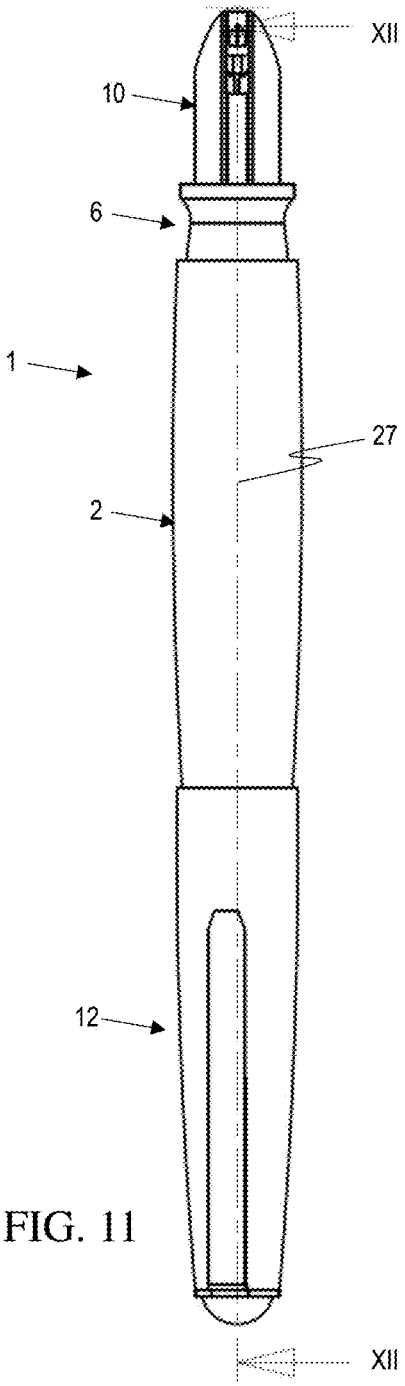
Figure 12:
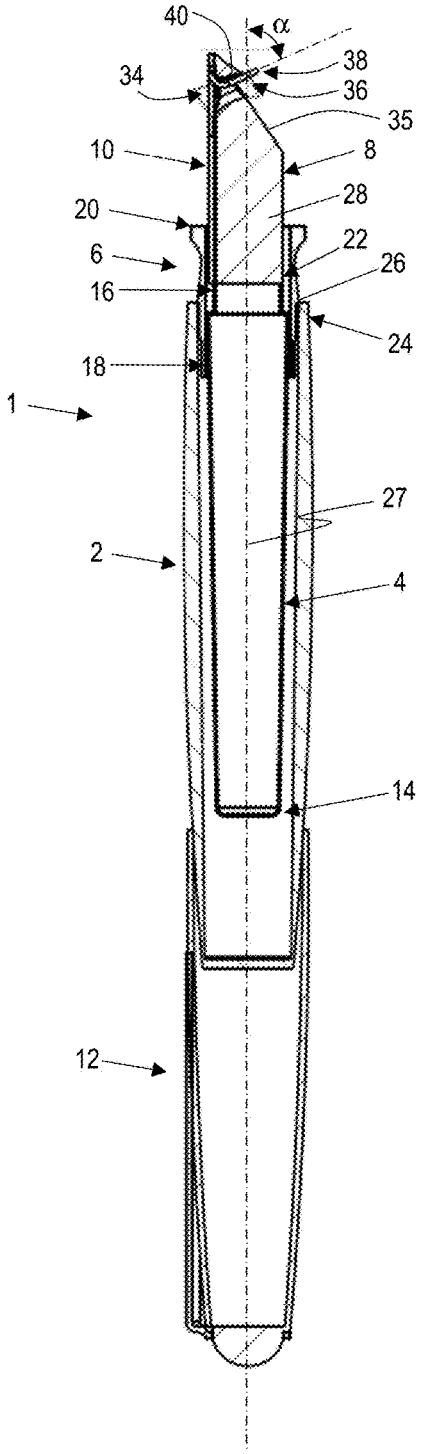
Figure 15A:
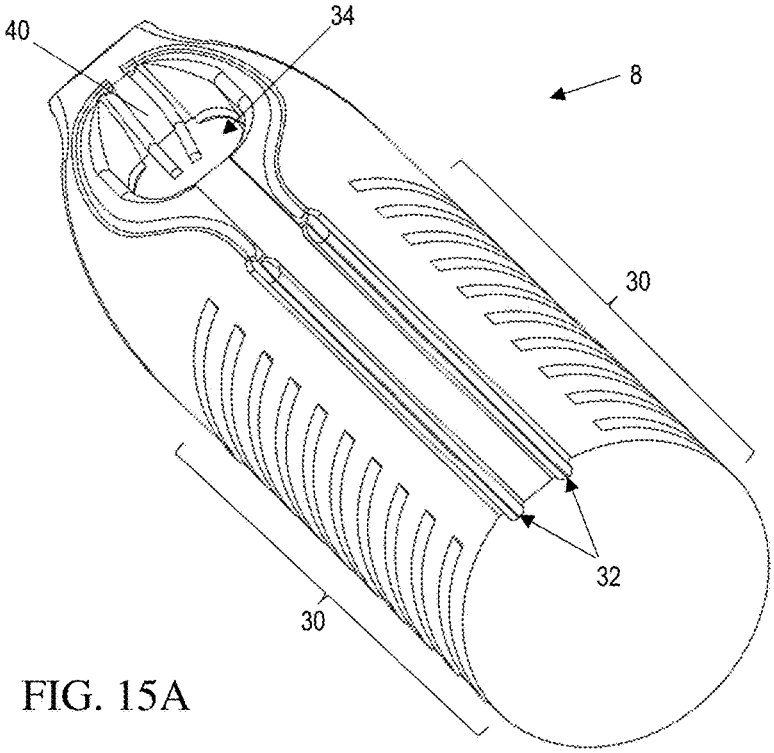
Figure 13:
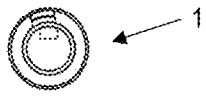
Figure 14:
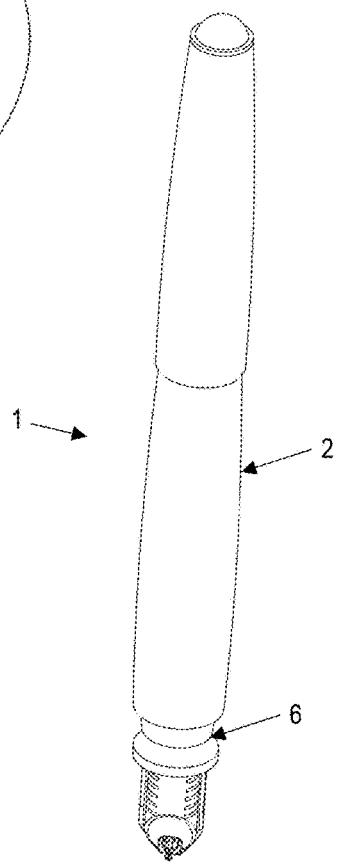
Figure 15B:
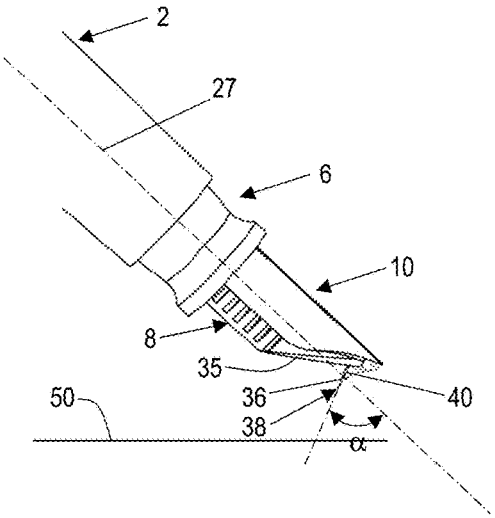
Figure 15C:
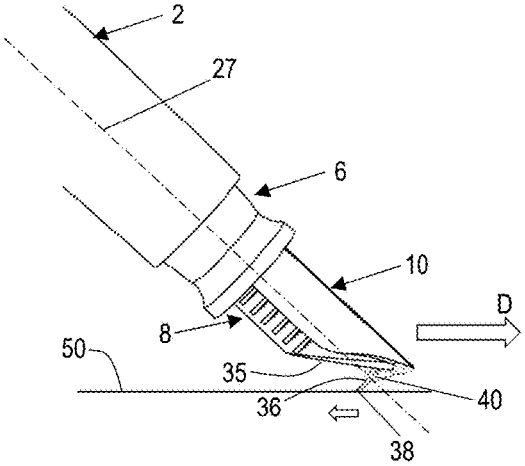
Figures 15D, 15E, 15F, 15G, 15H, 15I, 15J, 15K, 15L:
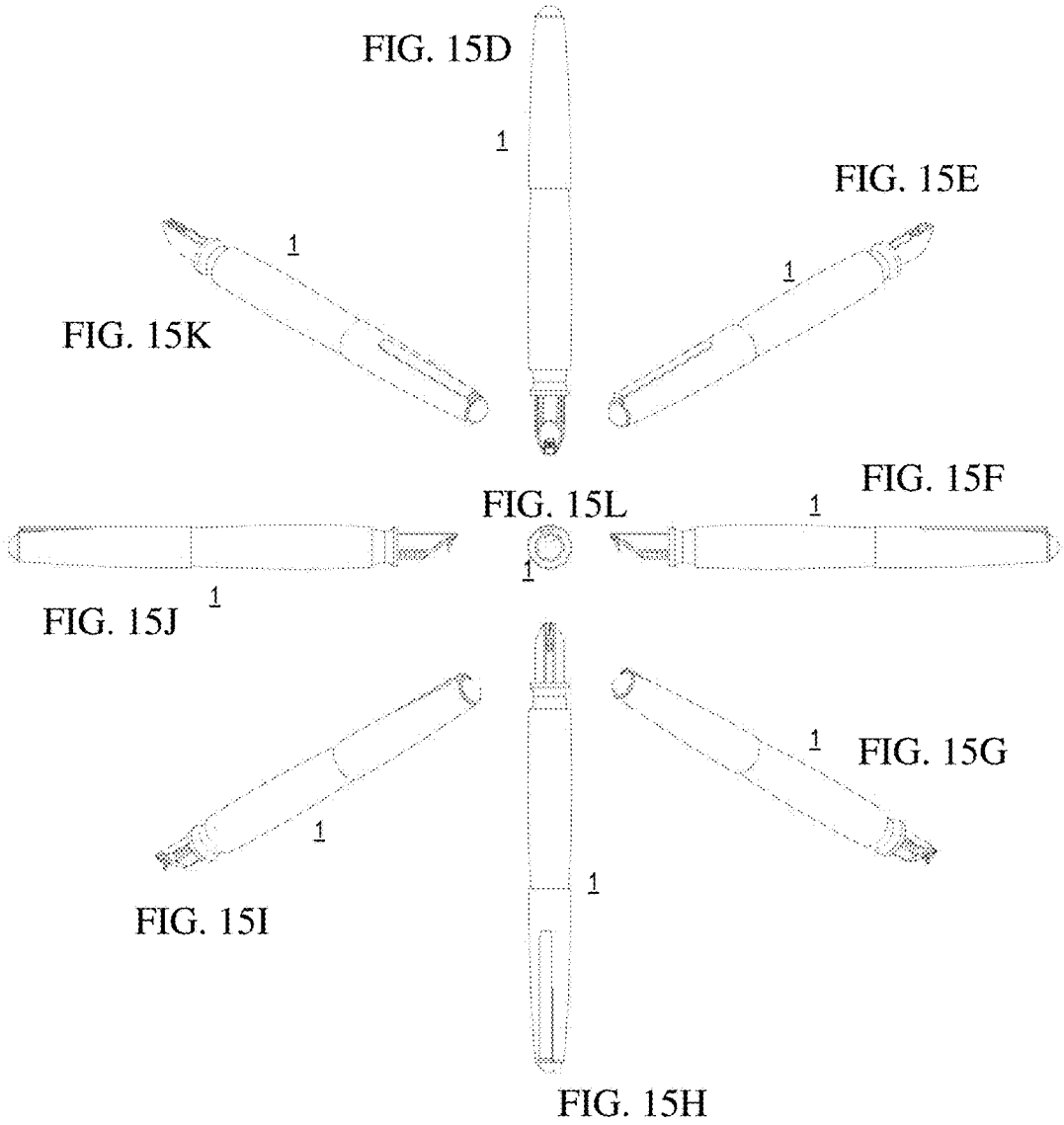

FIGS. 2-14 and 15A-C show a first pen 1 in accordance with aspects of the invention. FIGS. 2 and 3 show exploded views of the pen 1 including a shank 2, an ink tube 4, a connector 6, a feeder 8, a nib 10, and a cap 12. FIGS. 4-14 show various view of the pen 1 in an assembled state. FIGS. 5 and 8 show views of the assembled pen 1 with different portions of the nib 10 illustratively cutaway to show the feeder 8 underneath. FIG. 11 shows a plan view of the pen 1, and FIG. 12 shows a cross section along line XII-XII of FIG. 11. FIG. 15A shows an enlarged view of the feeder 8. FIGS. 15B and 15C show the first pen 1 in use. FIGS. 15D-L show additional views of a design of the pen 1.

As noted herein, FIGS. 2 and 3 show exploded views of the pen 1, and FIG. 12 shows a cross section of the assembled pen 1. Referring to these figures, in the assembled state of the pen 1, a first end 14 of the ink tube 4 is contained inside the shank 2 and a second end 16 of the ink tube 4 is contained inside a first end 18 of the connector 6. Additionally, a first end 22 of the feeder 8 is contained inside a second end 20 of the connector 6. The second end 16 of the ink tube 4 and the first end 22 of the feeder 8 may each be connected to the connector 6 by friction fit, screw threads, or similar connection mechanism. The ink tube 4 is configured to hold a volume of ink, a portion of the ink being deployed from the ink tube 4 to a writing surface when the pen 1 is used to write on the writing surface. Pens in accordance with aspects of the invention may be configured to use any suitable type of ink, including but not limited to water based ink, oil based ink, and gel based ink.

In the assembled state the connector 6 is connected to an open end 24 of the shank 2, e.g., by the first end 18 of the connector 6 being inserted into the interior of the open end 24 of the shank 2, the connection being secured by friction fit, screw threads, or similar connection mechanism. An outer surface of the connector 6 may include a shoulder 26 to define an extent to which the first end 18 is inserted into the open end 24 of the shank 2. As shown in FIGS. 11 and 12, the pen 1 has a longitudinal axis 27, which may be coaxial with at least one of: an axis of symmetry of the shank 2, an axis of symmetry of the ink tube 4, and an axis of symmetry of the connector 6.

As shown in FIG. 15A, the feeder 8 comprises a generally cylindrical body 28 having overflow channels 30 on lateral sides and two ink channels 32 on a top side. A hole 34 extends completely through the body 28 from the top side to an angled underside 35 (see FIG. 12). The ink channels 32 curve around the hole 34 at the top side of the body 28. The ink channels 32 may comprise troughs or grooves formed in an exterior surface of the body 28.

With particular reference to FIGS. 2, 3, 5, 7 and 12, the nib 10 comprises a sleeve that is arranged around a portion of the body 28 of the feeder 8 in the assembled state. The nib 10 also includes a writing tip 36 that is connected to the sleeve and that extends downward through the hole 34 of the feeder 8. The writing tip 36 has a lowermost free end that is a writing contact tip 38 that contacts a writing surface (e.g., paper) when the pen 1 is used for on the writing surface. In embodiments, the writing tip 36 and the sleeve of the nib 10 and are integrally formed of a same material. In a preferred embodiment, the feeder 8 is ebonite, the nib 10 is metal, and the writing tip 36 is an integral piece of the metal that extends downward through the hole 34 of the feeder 8. The nib 10 may be formed of a metal from the platinum family such as iridium. Plastic may alternatively be used for any one or more components of the pen 1.

Figure 21:
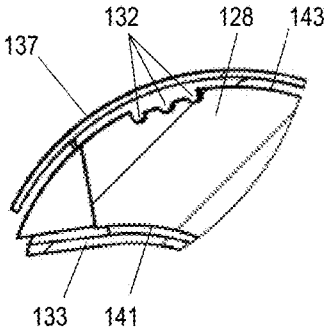

In the assembled state of the pen 1, the ink channels 32 are covered by the sleeve of the nib 10 and are in fluidic communication with the interior of the ink tube 4. FIGS. 5 and 8 depict the nib 10 with portions illustratively cutaway to show the ink channels 32 underneath. As shown in FIGS. 5 and 8, the ink channels 32 extend longitudinally along a top surface of the body 28, then curve around the hole 34 and extend down into the hole 34 along a front side surface of the hole 34. FIGS. 4 and 5 depict the writing tip 36 beginning at a top part of the nib 10 and extending downward through the hole 34 to terminate at the writing contact tip 38. In embodiments, the writing tip 36 arranged in this manner covers the ink channels 32 at the front side surface of the hole 34. In this manner, the ink channels 32 form a covered passageway that functions to convey ink from the interior of the ink tube 4 to a passage at the feeder 8 that is selectively opened and closed as described herein. In embodiments, there is a space (e.g., a gap) above the ink channels 32 and the underside of the sleeve of the nib 10 that covers the ink channels 32. This space allows a small amount of air to pass through and reduce the hydrostatic force or vacuum created by the presence of the ink, thereby allowing the ink to flow in the ink channels 32. FIG. 21 shows a similar gap in another embodiment.

As shown in FIGS. 4 and 5, the nib 10 may include a breather hole 37 at the top surface. The breather hole 37 helps release the ink flow onto the paper and may also function as a stress relief hole to prevent the nib from cracking when in use. The writing tip 36 may comprise two tines that extend from the nib 10, with an ink channel defined between the tines, the ink channel intersecting the breather hole 37.

In the assembled state of the pen 1, the writing tip 36 is resiliently biased to urge against a portion 40 of the feeder 8 at the front side surface of the hole 34, and the writing tip 36 is structured and arranged to be flexed (e.g., resiliently bent) away from the portion 40 of the feeder 8 when writing contact tip 38 contacts and a writing surface that pushes the writing tip 36 away from the portion 40 of the feeder 8. When the writing tip 36 is positioned against the portion 40 of the feeder 8, the contact of the writing tip 36 against the portion 40 prevents ink from flowing from the ink channels 32 to the writing contact tip 38. When the writing tip 36 is flexed away from the portion 40 of the feeder 8, a gap is created between the writing tip 36 and the portion 40, and ink may flow through this gap, i.e., from the ink channels 32 to the writing contact tip 38. In this manner, the writing tip 36 is resiliently biased against the feeder 8 and is selectively moveable between a first position in which ink flow between the writing tip 36 and the feeder 8 is prevented and a second position in which ink flow between the writing tip 36 and the feeder 8 is permitted.

FIG. 15B shows the writing tip 36 contacting the portion 40 of the feeder 8 when the writing contact tip 38 is not contacting a writing surface 50. FIG. 15C shows the writing tip 36 flexed away from the portion 40 of the feeder 8 when the writing contact tip 38 is contacting the writing surface 50. When the writing contact tip 38 contacts the writing surface 50 and the pen 1 is moved in a direction D, the writing contact tip 38 drags along the writing surface 50 and causes the writing tip 36 to flex in a direction opposite the direction D, and this flexing moves the writing tip 36 away from the portion 40 of the feeder 8 (i.e., toward the surface 35), thereby creating a gap between the writing tip 36 and the portion 40 of the feeder 8, the gap permitting ink to flow through the gap toward the writing contact tip 38 (FIG. 15C). When the pen 1 is lifted from the writing surface, the writing tip 36 resiliently returns to a position contacting the portion 40 of the feeder 8, thereby closing the gap and stopping the ink flow toward the writing contact tip 38 (FIG. 15B). Accordingly, an ink flow passage (i.e., a gap between the writing tip 36 and the portion 40 of the feeder 8) is selectively opened and closed based on a flexing movement of the writing tip 36 relative to the feeder 8. In this manner, the feeder 8 and the nib 10 are configured such that the writing tip 36 is moved from the first position (that prevents ink flow) to the second position (that permits ink flow) based on one of: a user holding the pen in their left hand places the writing contact tip in contact with a writing surface and moves the pen in a left to right writing direction; and a user holding the pen in their right hand places the writing contact tip in contact with a writing surface and moves the pen in a right to left writing direction.

According to aspects of the invention, when the writing tip 36 is contacting the portion 40 of the feeder 8 (e.g., as shown in FIG. 15B), the writing tip 36 is at an angle $\alpha$ relative to the longitudinal axis 27. In embodiments, the angle $\alpha$ is any non-zero angle that permits the writing tip 36 to function in the manner described herein, i.e., to stop ink flow when positioned against the portion 40 and to permit ink flow when flexed away from the portion 40 during the act of writing on a writing surface. In a preferred embodiment, the angle $\alpha$ is in a range of 45° to 90°. Unless otherwise noted, all values of angles disclosed herein have a tolerance of plus or minus 2 degrees. By configuring the pen 1 such that the angle $\alpha$ is about 45° to 90° degrees, a user holding the pen 1 in their left hand and writing from left to right (or a person holding the pen in their right hand and writing from right to left) may position the writing tip 36 relative to the writing surface in the half cone described with respect to FIG. 1. In this position, the writing contact tip 38 advantageously drags across the writing surface rather than digging into the writing surface. Moreover, the pen 1 may be structured and arranged such that the writing contact tip 38 is located on or very close to (e.g., within 1 to 2 mils of) the longitudinal axis 27. For example, FIG. 12 shows the writing contact tip 38 being offset from the longitudinal axis 27 by an amount, and in embodiments the amount of offset can be in the range of zero to two mils. By configuring the pen 1 such that the writing contact tip 38 is on (or very close to) the axis 27, the pen 1 may be centrally balanced such that the problem of an off-center pivot is avoided.

Figure 16:
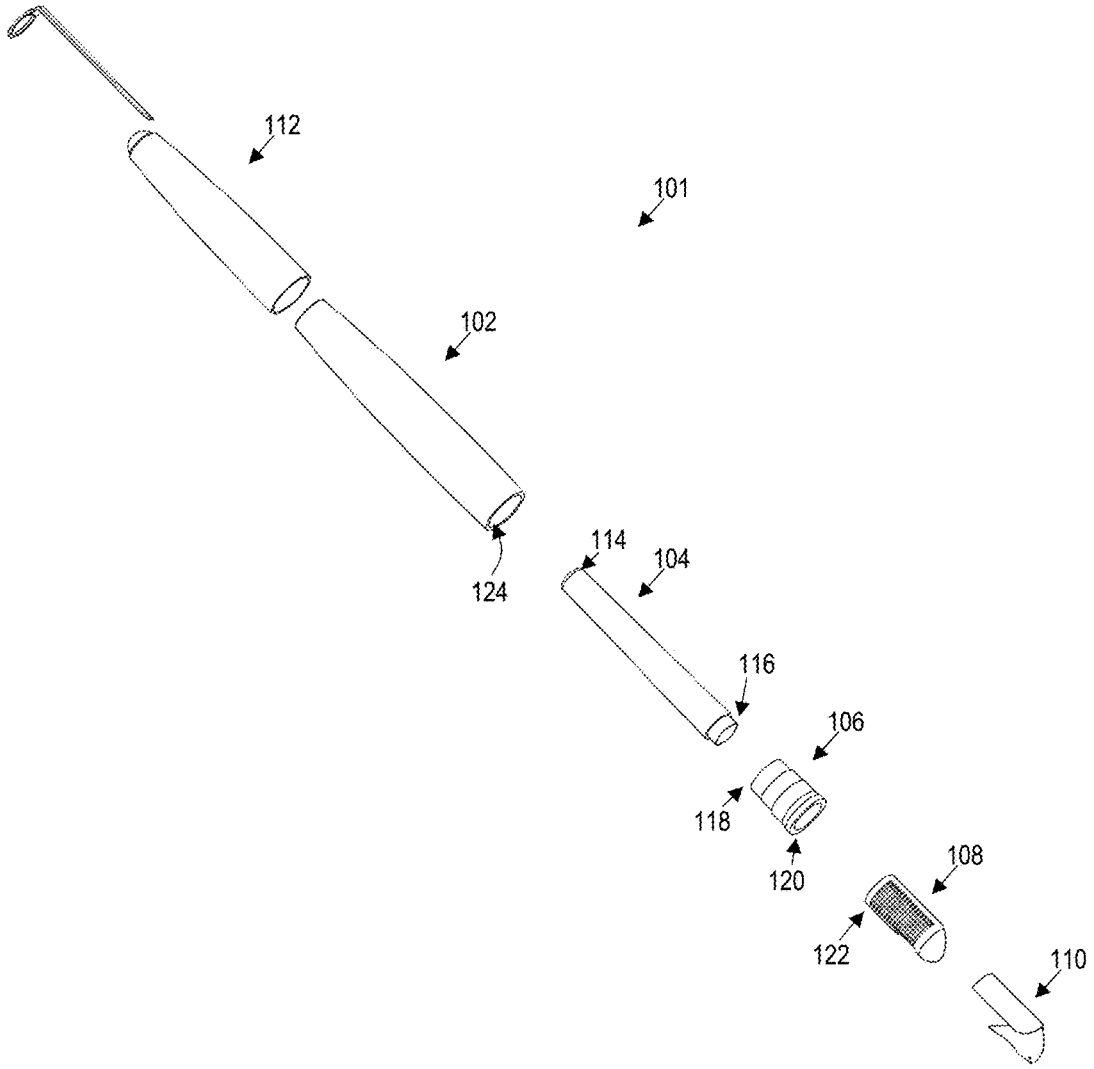
FIGS. 16-28 and 29A-I show another pen in accordance with aspects of the invention.
Figure 17:
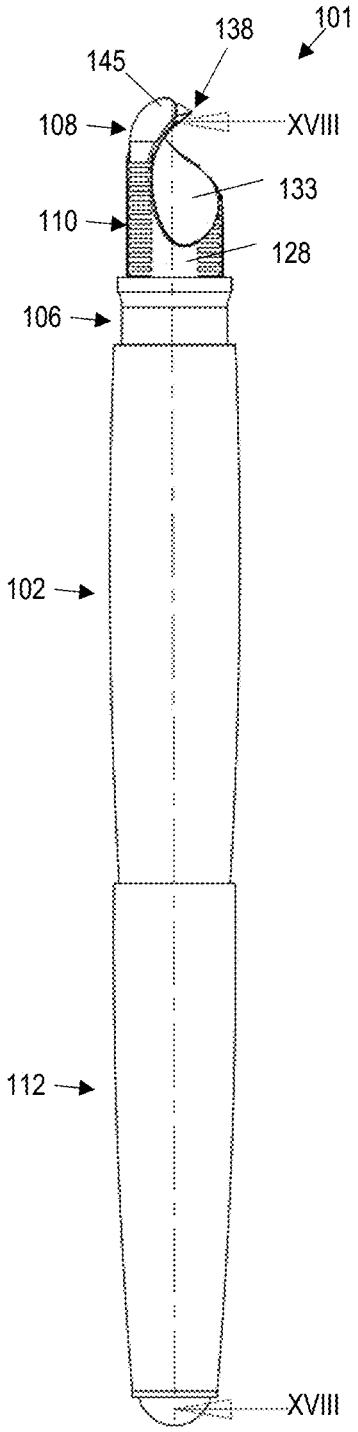
Figure 18:
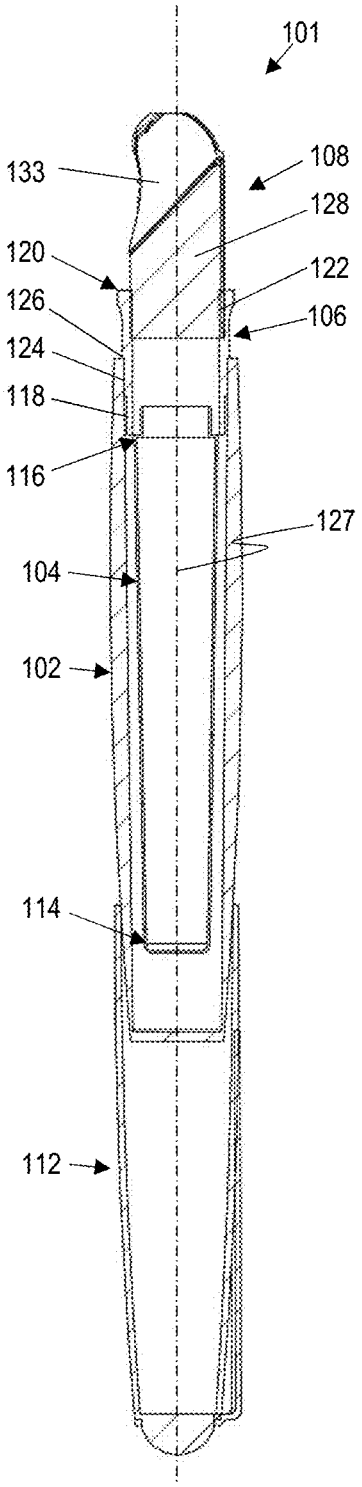

FIGS. 16-28 and 29A-I show a second pen 101 in accordance with aspects of the invention. FIG. 16 shows an exploded view of the pen 101. FIG. 17 shows a side view of the pen 101 in an assembled state, and FIG. 18 shows a cross section taken along line XVIII-XVIII of FIG. 17. FIGS. 19-21, 22A, and 22B show details of a feeder and nib of the pen 101. FIGS. 23-27 show various view of the pen 101 in an assembled state, some with portions of the nib illustratively cutaway to show the feeder underneath. FIG. 28 shows an alternative embodiment of the pen 101'. FIGS. 29A-I show additional views of a design of the pen 101.

Referring to FIG. 16, in embodiments the pen 101 includes a shank 102, ink tube 104, connector 106, feeder 108, nib 110, and cap 112. The shank 102, ink tube 104, connector 106, and cap 112 may be the same as the shank 2, ink tube 4, connector 6, and cap 2 of pen 1. As shown in FIG. 16, the ink tube 104 includes a first end 114 and a second end 116, and the connector 106 includes a first end 118 and a second end 120.

With reference to FIGS. 17 and 18, when the pen 101 is assembled, the first end 114 of the ink tube 104 is inside the shank 102, the second end 116 of the ink tube 104 is in the first end 118 of the connector 106, and the first end 122 of the feeder 108 is in the second end 120 of the connector 106. Also, the first end 118 of the connector 106 is in an opening 124 of the shank 102 up to a shoulder 126 on the exterior of the connector 106. The second end 116 of the ink tube 104 and the first end 122 of the feeder 108 may each be connected to the connector 106 by friction fit, screw threads, or similar connection mechanism. As with pen 1, pen 101 is structured and arranged such that ink is stored in the ink tube 104 and flows from the ink tube 104 via the connector 106 to ink channels in the feeder 108, as described in greater detail herein. A longitudinal axis 127 of the pen 101 is coaxial with at least one of an axis of symmetry of the shank 102, an axis of symmetry of the ink tube 104, and an axis of symmetry of the connector 106. As shown in FIGS. 17 and 18, the feeder 108 includes a body 128 and the nib 110 includes an inner element 133 and a writing contact tip 138. The pen 101 may be structured and arranged such that the writing contact tip 138 is located on or very close to (e.g., within 1 to 2 mils of) the longitudinal axis 127. For example, FIGS. 17 and 18 show the writing contact tip 138 being offset from the longitudinal axis 127 by an amount, and in embodiments the amount of offset can be in the range of zero to two mils. By configuring the pen 101 such that the writing contact tip 138 is on (or very close to) the axis 127, the pen 101 may be centrally balanced such that the problem of an off-center pivot is avoided.

Figure 19:
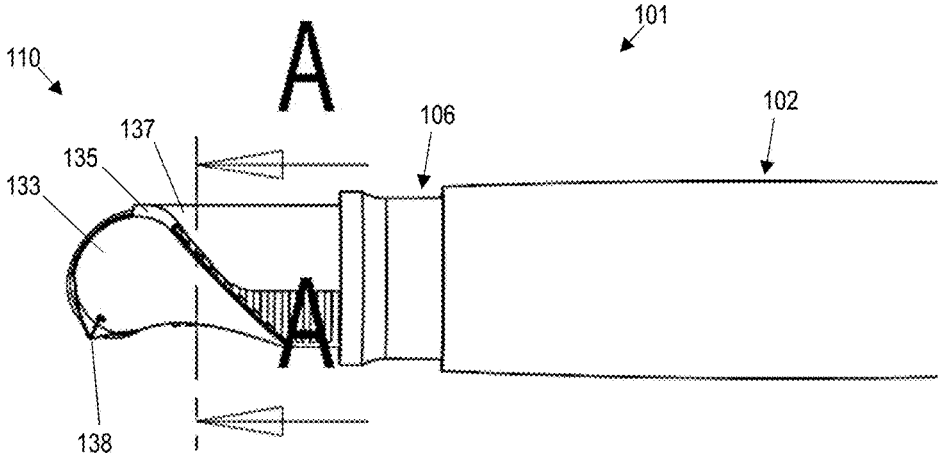
Figure 20:
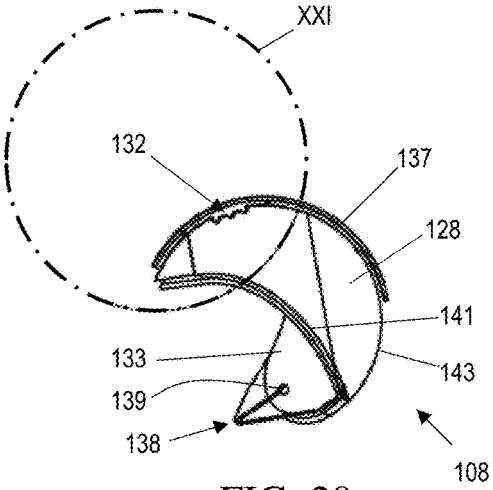

FIGS. 19-21 show details of the feeder 108 and nib 110 in accordance with aspects of the invention. FIG. 20 is a cross section taken along line A-A of FIG. 19, and FIG. 21 is a close-up of the section defined by circle XXI of FIG. 20. As shown in FIG. 19, the nib 110 includes the inner element 133, an outer element 137, and a transition element 135 connecting the inner element 133 and the outer element 137. As defined and used herein, the inner element 133 has a convex inner surface and a concave outer surface, and the outer element 137 has a convex outer surface and a concave inner surface. As shown in FIGS. 20 and 21, the body 128 of the feeder 108 includes an inner concave surface 141 and an outer convex surface 143.

As shown in FIGS. 19-21, in the assembled state of the pen 101, the nib 110 wraps around the body 128 of the feeder 108. In the assembled state, the inner element 133 of the nib 110 is adjacent to and covering the concave surface 141 of the feeder 108, and the outer element 137 of the nib 110 is adjacent to and covering the convex surface 143 of the feeder 108. As shown in FIGS. 19 and 20, the inner element 133 of the nib 110 may include a breather hole 139 that intersects an ink channel between two tines that extend to the writing contact tip 138.

As shown in FIGS. 20 and 21, the convex surface 143 of the feeder 108 includes ink channels 132. According to aspects of the invention, the ink channels 132 are part of a fluid path that conveys ink from the ink tube 104 to the writing contact tip 138. Three ink channels 132 are shown, but any appropriate number may be used. In embodiments, the ink channels 132 comprise troughs or grooves formed in the body 128 of the feeder 108.

Figure 23:
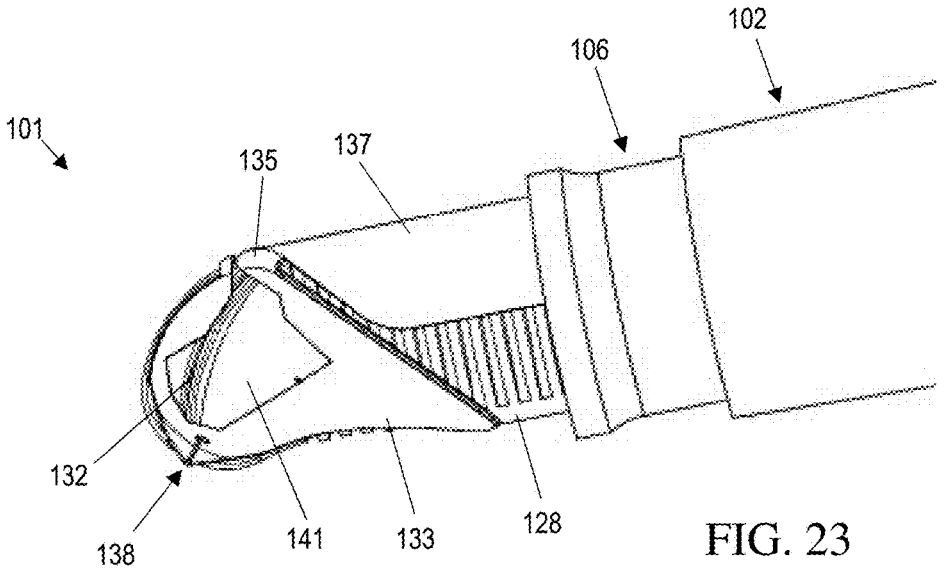
Figure 24:
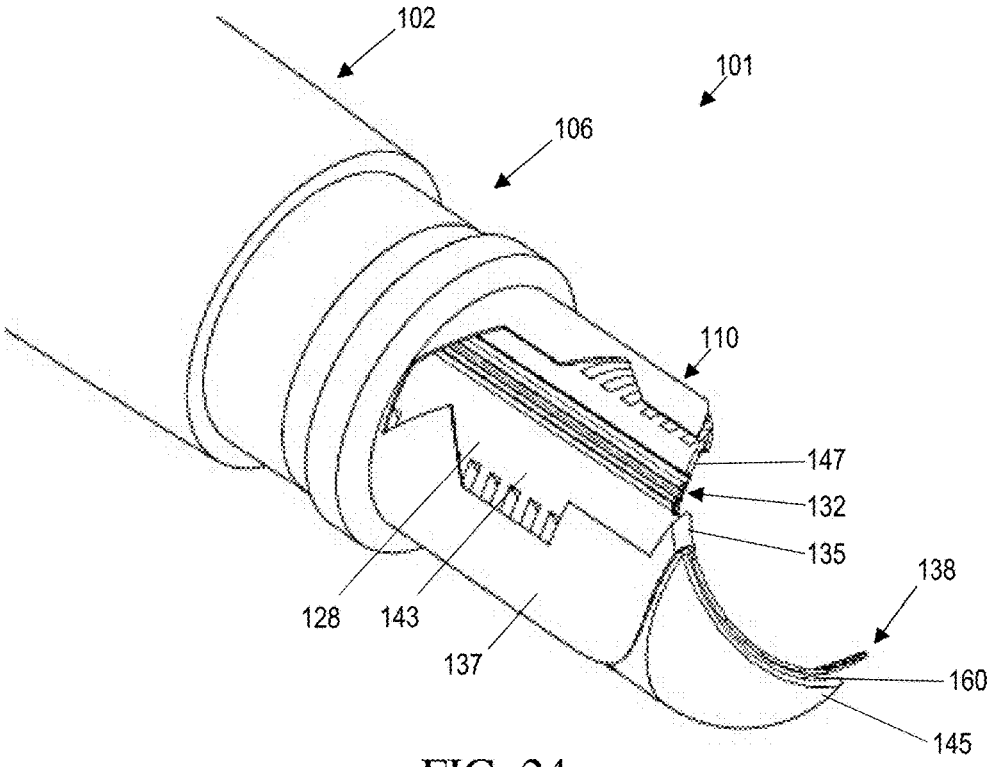
Figure 25:
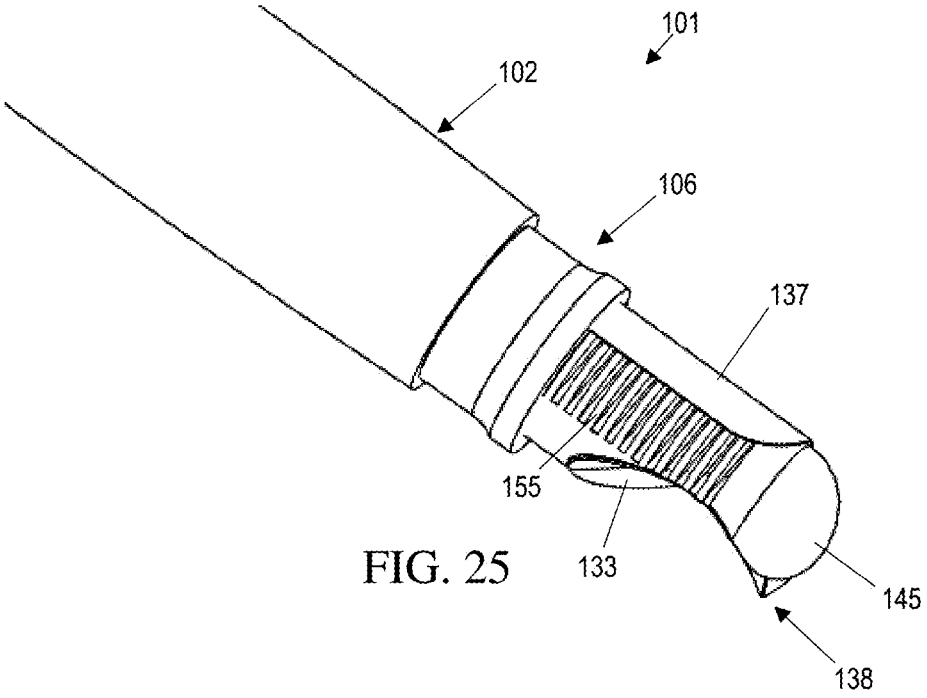
Figure 26:
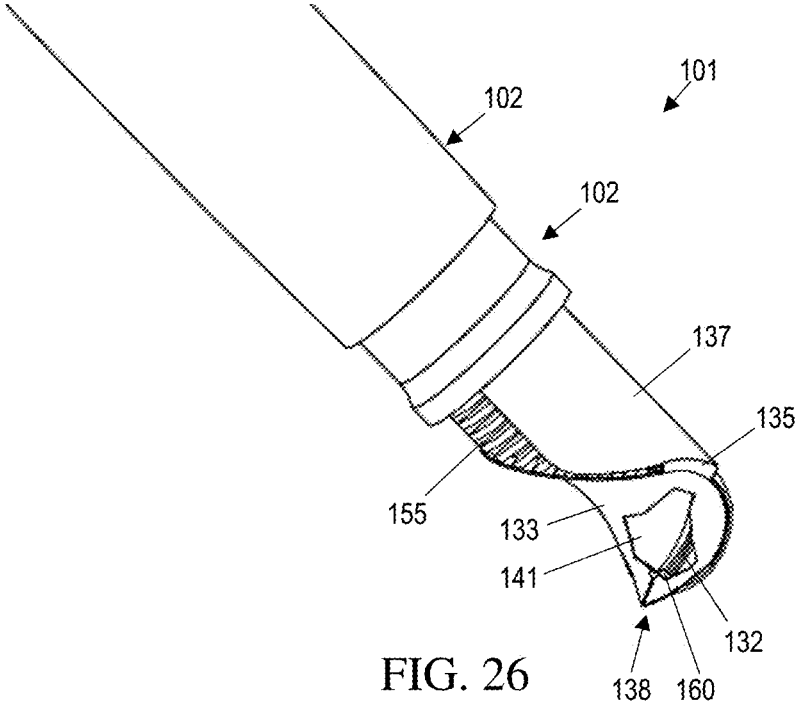

FIG. 24 shows the pen 101 with a portion of the outer element 137 of the nib 110 illustratively cutaway to show the ink channels 132 at the convex surface 143 of the feeder 108. As shown in FIG. 24, the ink channels 132 extend to an edge 147 of the body 128, the edge 147 connecting the convex surface 143 and the concave surface 141 of the body 128. In embodiments, the convex surface 143 and the concave surface 141 provide a portion of the feeder 108 with a spiral (helical) shape, with the edge 147 being curved along its length where it connects the convex surface 143 and the concave surface 141 in this spiral portion. According to aspects of the invention, the ink channels 132 are formed in the edge 147 and continue in the concave surface 141 to a termination near a distal end 145 of the feeder 108. FIGS. 23 and 26 show the pen 101 with a portion of the inner element 133 of the nib 110 illustratively cutaway to show the ink channels 132 at the concave surface 141 of the feeder 108. The ink channels 132 thus extend continuously from the convex surface 143 to the edge 147, and from the edge 147 to the concave surface 141. In this manner, the ink channels 132 provide a continuous path for ink to be conveyed from the ink tube 104 to the writing contact tip 138.

As shown in FIGS. 20, 21, 23, and 24, the outer element 137 of the nib 110 covers the ink channels 132 at the convex surface 143 of the feeder 108. In embodiments, there is a space (e.g., a gap) above the ink channels 132 and the underside of the outer element 137 of the nib 110 that covers the ink channels 32. This space allows a small amount of air to pass through and reduce the hydrostatic force or vacuum created by the presence of the ink, thereby allowing the ink to flow in the ink channels 132. Also, the inner element 133 of the nib 110 covers the concave surface 141 of the feeder 108. Moreover, the transition element 135 of the nib 110 covers the ink channels 132 at the edge 147 of the feeder 108. In this manner, the plural elements of the nib 110 cover the ink channels 132 in the plural surfaces of the feeder 108 and are configured to confine the ink to the ink channels 132. Overflow grooves 155 are provided in the body 128 of the feeder 108 to capture any ink that escapes from the ink channels 132.

According to aspects of the invention, a portion of the convex inner surface 160 of the inner element 133 of the nib 110 is resiliently biased into contact with the concave surface 141 of the feeder 108 at a termination of the ink channels 132 near the distal end 145 of the feeder 108, near the writing contact tip 138. In embodiments, the inner surface 160 of the nib 110 being in contact with the concave surface 141 of the feeder 108 stops the flow of ink from the ink channels 132 to the writing contact tip 138. When sufficient force is applied to the writing contact tip 138 is an appropriate direction, the inner element 133 of the nib 110 is configured to resiliently flex away from the concave surface 141 of the feeder 108 to temporarily create a gap there between to permit ink to flow from the termination of the ink channels 132 to the writing contact tip 138. When the force is removed, the inner element 133 of the nib 110 is configured to resiliently move back into the contact position against the concave surface 141 of the feeder to stop the ink flow. In this manner, inner element 133 is resiliently biased against a portion of the feeder 108 and is selectively moveable between a first position in which ink flow between the inner element 133 and the portion of the feeder 108 is prevented and a second position in which ink flow between the inner element 133 and the portion of the feeder 108 is permitted.

Figure 22A:
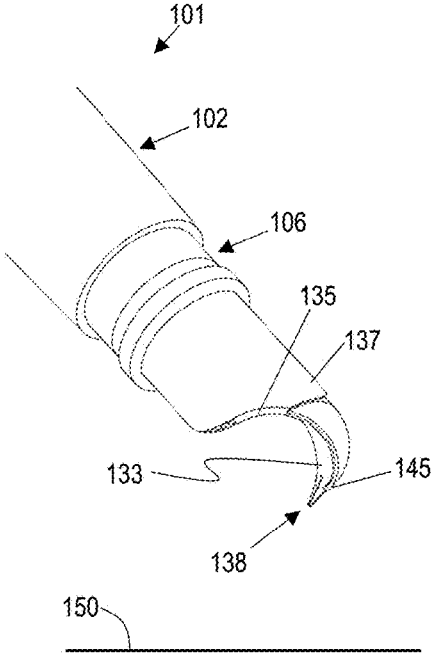
Figure 22B:
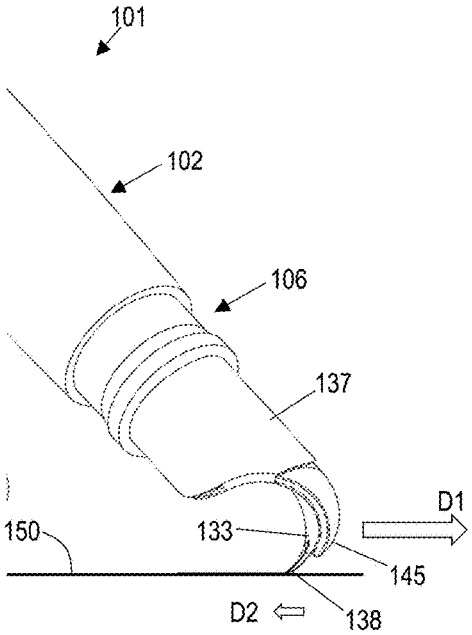

FIGS. 22A and 22B demonstrate the control of ink flow in accordance with aspects of the invention. FIG. 22A shows the pen 101 when the writing contact tip 138 is not contacting a writing surface 150. In FIG. 22A, the inner element 133 of the nib 110 is resiliently biased into contact with the concave surface 141 of the feeder 108 at a termination of the ink channels 132 to shut off the ink flow from the ink channels 132 to the writing contact tip 138. FIG. 22B shows the pen 101 when the writing contact tip 138 is contacting the writing surface 150 and the pen 101 is being moved in the direction D1. In FIG. 22B, the force being applied to the writing contact tip 138 by the movement of the pen 101 across the writing surface 150 moves (e.g., flexes) the inner element 133 of the nib 110 in an opposite direction D2 away from the concave surface 141 of the feeder 108 to create a gap there between that permits ink to flow from the termination of the ink channels 132 to the writing contact tip 138. When the pen 101 is lifted from the writing surface 150, the inner element 133 resiliently moves back a position contacting the concave surface 141, as shown in FIG. 22A, to stop the ink flow again. In this manner, the feeder 108 and the nib 110 are configured such that the inner element 133 is moved from the first position to the second position based on one of: a user holding the pen in their left hand places the writing contact tip in contact with a writing surface and moves the pen in a left to right writing direction; and a user holding the pen in their right hand places the writing contact tip in contact with a writing surface and moves the pen in a right to left writing direction.

By configuring the pen 101 with the concave surface 141 of the feeder 108 and corresponding inner element 133 of the nib 110, a user holding the pen 101 in their left hand and writing from left to right (or a person holding the pen in their right hand and writing from right to left) may position the writing contact tip 138 relative to the writing surface in the half cone described with respect to FIG. 1. In this position, the writing contact tip 138 advantageously drags across the writing surface rather than digging into the writing surface.

Figure 27:
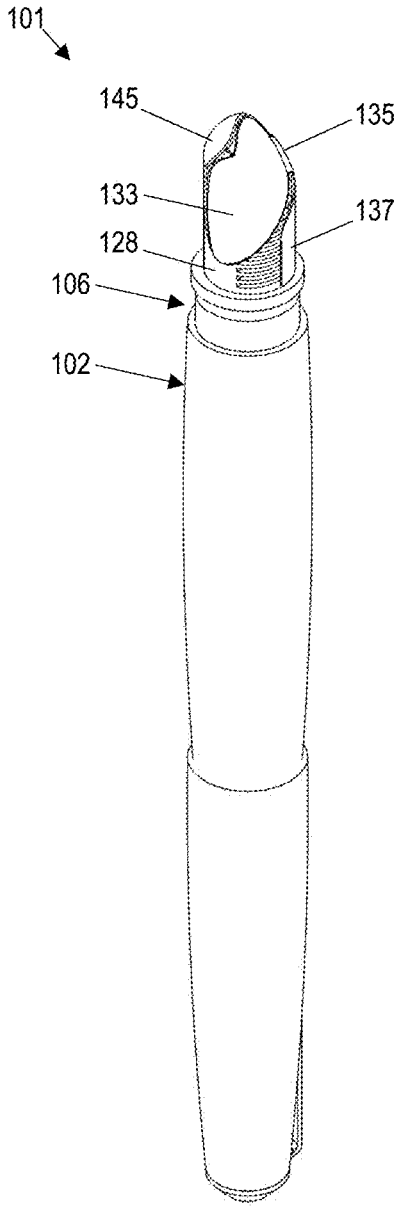
Figure 28:
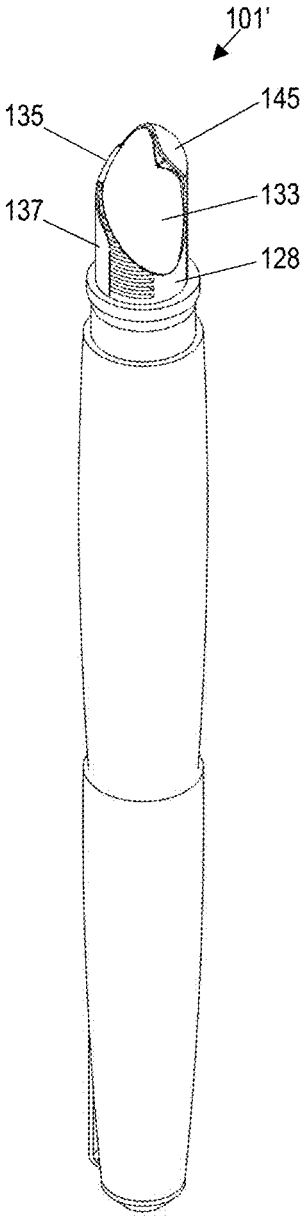
Figure 29A:
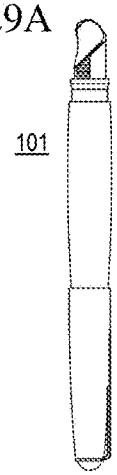
Figure 29B:
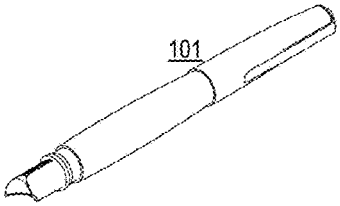
Figure 29H:
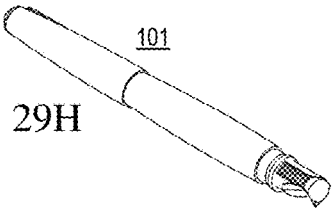
Figure 29I:
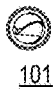
Figure 29C:
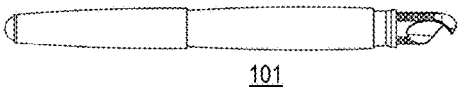
Figure 29G:
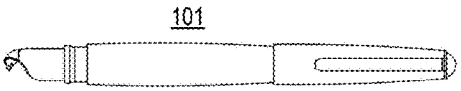
Figure 29F:
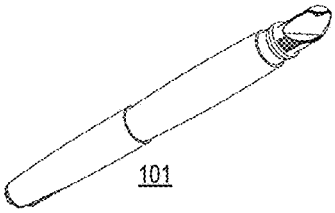
Figure 29D:
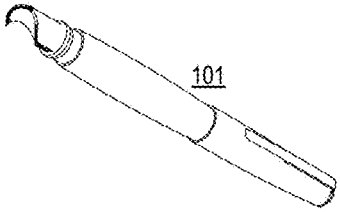
Figure 29E:
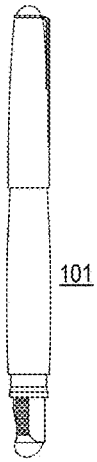

As shown in FIGS. 27 and 28, the concave cavity of the feeder may be formed in (e.g., cut into) the feeder from two different angles. FIG. 27 shows the pen 101 with the concave cavity formed at a first angle, and FIG. 28 shows the pen 101' with the concave cavity formed at a second angle different from the first angle. Depending on the angle of the cavity, the tip will either point upwards or downwards, depending in the preference of the user.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A pen, comprising:

a shank;

an ink tube;

a connector connected to the ink tube and the shank;

a feeder connected to the connector; and a nib connected to the feeder, wherein a writing tip of the nib extends through a hole in the feeder, and the writing tip is resiliently biased against the feeder and is selectively moveable between a first position in which ink flow between the writing tip and the feeder is prevented and a second position in which ink flow between the writing tip and the feeder is permitted.

2. The pen of claim 1, wherein the writing tip is resiliently biased to the first position in which ink flow between the writing tip and the feeder is prevented.

3. The pen of claim 1, further comprising at least one ink channel that: extends along a top surface of the feeder, curves around the hole, and extends through the hole along a front side surface of the hole.

4. The pen of claim 3, wherein the at least one ink channel provides a flow path for ink from the ink tube to a location where the writing tip is resiliently biased against the feeder.

5. The pen of claim 3, wherein the at least one ink channel comprises two ink channels that extend around opposite side of the hole.

6. The pen of claim 1, wherein the writing tip extends through the hole at a non-zero angle relative to a longitudinal axis of the pen.

7. The pen of claim 6, wherein the longitudinal axis of the pen is coaxial with at least one of: an axis of symmetry of the shank, an axis of symmetry of the ink tube, and an axis of symmetry of the connector.

8. The pen of claim 6, wherein the non-zero angle is a range of 45° to 90°.

9. The pen of claim 1, wherein the feeder and the nib are configured such that the writing tip is moved from the first position to the second position based on one of:

a user holding the pen in their left hand places the writing contact tip in contact with a writing surface and moves the pen in a left to right writing direction; and a user holding the pen in their right hand places the writing contact tip in contact with a writing surface and moves the pen in a right to left writing direction.

10. The pen of claim 1, wherein the pen is a fountain pen.

11. A pen, comprising:

a shank;

an ink tube;

a connector connected to the ink tube and the shank;

a feeder connected to the connector; and a nib connected to the feeder, wherein the feeder comprises a concave surface and a convex surface;

the nib comprises: an inner element covering the concave surface; an outer element covering the convex surface; and a writing contact tip; and the inner element is resiliently biased against a portion of the feeder and is selectively moveable between a first position in which ink flow between the inner element and the portion of the feeder is prevented and a second position in which ink flow between the inner element and the portion of the feeder is permitted.

12. The pen of claim 11, wherein the inner element is resiliently biased to the first position in which ink flow between the inner element and the portion of the feeder is prevented.

13. The pen of claim 11, wherein:

the inner element corresponds in size and shape to the concave surface; and the outer element corresponds in size and shape to the convex surface.

14. The pen of claim 11, further comprising at least one ink channel formed in the convex surface and the concave surface.

15. The pen of claim 14, wherein:

the outer element covers the at least one ink channel on the convex surface; and the inner element covers the at least one ink channel on the concave surface.

16. The pen of claim 15, wherein:

the nib comprises a transition element that connects the outer element and the inner element;

the feeder comprises an edge that connects the convex surface and the concave surface;

the at least one ink channel is formed in the edge; and the transition element covers the ink channel at the edge.

17. The pen of claim 11, wherein the feeder and the nib are configured such that the inner element is moved from the first position to the second position based on one of:

a user holding the pen in their left hand places the writing contact tip in contact with a writing surface and moves the pen in a left to right writing direction; and a user holding the pen in their right hand places the writing contact tip in contact with a writing surface and moves the pen in a right to left writing direction.

18. The pen of claim 11, wherein the pen is a fountain pen.

* * * * *